US006595383B2

(12) United States Patent
Pietrantoni

(10) Patent No.: US 6,595,383 B2
(45) Date of Patent: Jul. 22, 2003

(54) PACKAGING FOR SHIPPING COMPRESSED GAS CYLINDERS

(75) Inventor: Dennis P. Pietrantoni, Lancaster, NY (US)

(73) Assignee: Scott Technologies, Inc., Beachwood, OH (US)

( * ) Notice: Subject to any disclaimer, the term of this patent is extended or adjusted under 35 U.S.C. 154(b) by 0 days.

(21) Appl. No.: 09/791,534

(22) Filed: Feb. 22, 2001

(65) Prior Publication Data

US 2001/0040166 A1 Nov. 15, 2001

Related U.S. Application Data

(60) Provisional application No. 60/184,125, filed on Feb. 22, 2000.

(51) Int. Cl.[7] ..... F17C 1/12

(52) U.S. Cl. ..... 220/586; 220/560.11

(58) Field of Search ..... 220/560.01, 560.03, 220/560.12, 560.15, 560.1, 560.05, 592.24, 592.26, 592.2, 592.23, 592.25, 23.87, 23.86, 23.91, 506, 605, 729, 88.1, 918, 919, 920, 581, 586, 560.11

(56) References Cited

U.S. PATENT DOCUMENTS

| | | | | | |
|---|---|---|---|---|---|
| 767,622 | A | * | 8/1904 | Abderhalden | 220/592.23 |
| 1,324,653 | A | * | 12/1919 | Ferdon | 206/499 |
| 2,103,677 | A | * | 12/1937 | Kline et al. | 220/592.19 |
| 2,644,578 | A | * | 7/1953 | Bramming | 206/543 |
| 3,314,584 | A | | 4/1967 | Knapp et al. | 229/14 |
| 3,404,826 | A | | 10/1968 | Carmody | 229/14 |
| 3,572,574 | A | | 3/1971 | Mears | 229/14 |
| 3,938,661 | A | | 2/1976 | Carmody | 206/523 |
| 4,287,265 | A | | 9/1981 | McKnight | 428/542 |
| 4,407,898 | A | | 10/1983 | Kato et al. | 428/542.8 |
| 4,560,069 | A | | 12/1985 | Simon | 206/591 |
| 4,815,605 | A | * | 3/1989 | Brissier et al. | 206/523 |
| 4,836,379 | A | | 6/1989 | Shaw | 206/523 |
| 4,851,286 | A | | 7/1989 | Maurice | 428/316.6 |
| 4,905,855 | A | * | 3/1990 | Troiano et al. | 206/6 |
| 5,005,705 | A | | 4/1991 | Combs | 206/586 |
| 5,038,456 | A | * | 8/1991 | McGarvey | 220/560.01 |
| 5,050,731 | A | | 9/1991 | Baynes et al. | 206/320 |
| 5,071,009 | A | | 12/1991 | Ridgeway | 206/586 |
| 5,111,957 | A | | 5/1992 | Hollander et al. | |
| 5,405,464 | A | * | 4/1995 | Mosser | 148/656 |
| 5,628,402 | A | | 5/1997 | Dickie et al. | 206/521 |
| 5,638,896 | A | | 6/1997 | Nishino et al. | 165/132 |
| 5,829,629 | A | * | 11/1998 | Usher | 220/23.91 |
| 5,866,079 | A | * | 2/1999 | Machida et al. | 422/179 |
| 6,128,874 | A | * | 10/2000 | Olson et al. | 52/232 |

FOREIGN PATENT DOCUMENTS

DE 295 04 788 U 8/1995

* cited by examiner

*Primary Examiner*—Stephen Castellano
(74) *Attorney, Agent, or Firm*—Hodgson Russ LLP

(57) ABSTRACT

An overpack is provided for packaging cylinders containing compressed gas. Cylinders containing compressed gas typically have a pressure relief mechanism that releases the gas from the cylinder when the pressure inside the cylinder approaches a pressure detrimental to the cylinder. In high heat, high temperature situations such as when the overpack is exposed to a fire, the overpack of the present invention extends the time that it takes for the cylinders to trigger the pressure relief mechanism.

19 Claims, 12 Drawing Sheets

PACKAGING FOR SHIPPING COMPRESSED GAS CYLINDERS

CROSS-REFERENCE TO RELATED APPLICATION

Applicant hereby claims priority based on U.S. Provisional Application No. 60/184,125 filed Feb. 22, 2000, entitled "Packaging for Shipping Compressed Gas Cylinders" which is incorporated herein by reference.

FIELD OF INVENTION

The present invention pertains to packaging for storage cylinders designed for storing compressed gases, and in particular an apparatus and method for packaging cylinders containing compressed oxygen.

BACKGROUND OF THE INVENTION

In the handling of compressed gases stored in vessels such as cylinders, it is known that exposure of the cylinders to heat and increased temperatures may cause the pressure inside the cylinder to increase. It is also known to provide a pressure-relief mechanism that will open to vent the gas to the surrounding environment, if the pressure within the cylinder reaches levels that may be detrimental to the cylinder.

There are instances, however, where it is advantageous to delay the operation of the pressure-relief mechanism to prevent the contents of the cylinder from being released. One such instance involves the transportation of compressed oxygen cylinders in cargo holds. If the cargo hold is provided with flame retardant walls and is sealed, the fire may smolder or suffocate before causing any serious damage. In such a situation, it would be disadvantageous to allow the oxygen inside the cylinders to release into the area surrounding the cylinders because the oxygen may worsen the fire. Other instances where the present invention would be advantageous would include the shipment of toxic gases in cylinders in cargo holds.

For shipping cylinders containing compressed oxygen it has been known to provide an outer packaging or overpack to protect the cylinders from reaching temperatures that may trigger the pressure-relief mechanism.

It has been determined that the ATA 300 provides a significant amount of thermal protection to a cylinder exposed to a high temperature environment.

The ATA 300 is an overpack or outer packaging commonly used by airlines to transport their oxygen cylinders (ATA specification No. 300, Packaging of Airline Supplies, Category I). An ATA Specification No. 300 Category I (ATA 300) overpack or outer packaging is a resilient, durable overpack intended to be reused for a minimum of 100 round trips.

The ATA 300 cases have several drawbacks including their size and weight. The cases are rigid and bulky, and they are expensive. Also, because of the expense and durability of the cases, they have to be returned to their owner after each use. Accordingly, there is a need for a more economical, single use overpack that extends the time before a pressure relief mechanism on a compressed oxygen cylinder is triggered when the cylinder is exposed to elevated temperatures and that provides thermal protection comparable to the ATA 300.

SUMMARY OF THE INVENTION

The present invention meets the above-described need by providing a single use overpack and a method for packing a compressed gas cylinder in an overpack, that provides thermal protection that is the same as or better than the ATA 300, but is more economical to use and to manufacture.

The present invention provides a first container having openings at opposite ends and capable of being sealed by foldable flaps. The first container receives a cylinder with a valve. The cylinder contains a compressed gas and is equipped with a pressure relief mechanism for releasing the gas when the pressure inside the cylinder approaches a pressure detrimental to the cylinder. The cylinder and valve are typically enclosed in a protective bag. The bottom of the cylinder is provided with a bottom ring that conforms to the shape of the cylinder to prevent the cylinder from moving inside the first container. At the opposite end, a head ring is disposed around the top of the cylinder and around the valve. The head ring also prevents the cylinder from moving inside the first container and protects the valve from contact with the end of the container or the side walls of the container such that the valve is not inadvertently actuated or damaged during transportation.

Once the cylinder equipped with the head ring is placed in the first container, any remaining space at the end to be closed is filled with dunnage such that the cylinder is obstructed from moving inside the first container.

Next, the first container is wrapped with a fiber paper having low thermal conductivity and high heat reflectance properties. The fiber paper is flexible and can be cut to size such that it can be wrapped around the sides of the first container. The top and bottom of the first container are then provided with an end cap cardboard spacer. The first container with the fiber paper wrapped around the sides and with the spacers at the top and bottom is then inserted into a second container. The side walls of the first container are disposed in spaced apart parallel relation to the walls of the second container. The end cap spacer at the top and bottom of the first container provides for positioning of the first container inside the second container, prevents the first container from moving inside the second container, and prevents contact between the first and second container. As an alternative, the fiber paper may be bonded or otherwise attached to the inside surface of the second container.

The second container is preferably coated on its exterior with a flame retardant coating. As an alternative, the second container may also be provided with a flame retardant coating on its interior.

The second container may be provided with endcap spacers and then inserted into a third container, if necessary. The side walls of the second container would be disposed in spaced apart parallel relation to the walls of the third container. Also, as an alternative arrangement, a thermal barrier in the form of fiber paper could be disposed between the second and third containers such as by wrapping the paper around the second container or attaching the paper to the inside of the third container.

Accordingly, multiple containers disposed within each other in spaced apart relation could be provided. The successive containers may also be coated on the exterior or interior surfaces with a flame retardant substance.

BRIEF DESCRIPTION OF THE DRAWINGS

The invention is illustrated in the drawings in which like reference characters designate the same or similar parts throughout the figures of which.

DESCRIPTION OF THE PREFERRED EMBODIMENTS

Figure 1:
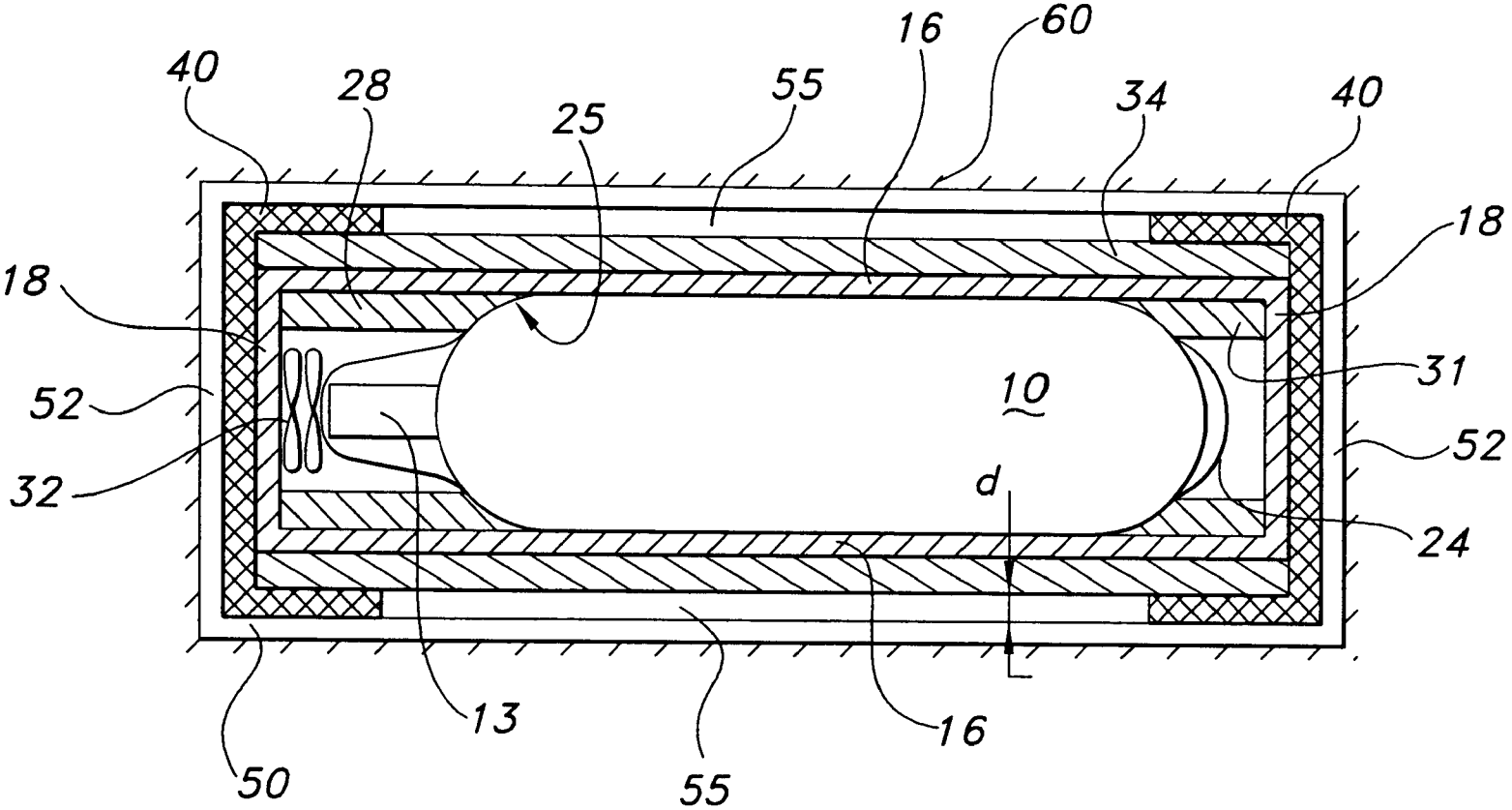
FIG. 1 is a cut-away plan view illustrating the apparatus and method of the present invention.

The present invention now will be described more fully hereinafter with reference to the accompanying drawings, in which one embodiment of the invention is shown. This invention may, however, be embodied in many different forms and should not be construed as limited to the embodiment set forth herein. Rather, this embodiment is provided so that this disclosure will be thorough and complete, and will fully convey the scope of the invention to those skilled in the art. Like numbers refer to like elements throughout.

Referring to FIGS. 1–3B, a storage cylinder 10 of the type typically used to store gases under pressure is shown. As known to those of ordinary skill in the art, the storage cylinder 10 is constructed of materials such as steel or aluminum and which may incorporate fiber reinforcement, such as fiberglass or carbon fiber, and having sufficient strength to withstand internal pressures associated with compressed gases. The shape of the tank and the gas stored inside of the tank are variable. By way of example, the cylinder 10 is filled with compressed oxygen. It is known by those of ordinary skill in the art to provide these type of storage cylinders 10 with valves 13 at the inlet to the cylinder 10. Many of the cylinders 10 contain a pressure-relief mechanism such as a burst disk that will release the gas contents from the cylinder 10 in response to a certain level of internal pressure in the cylinder 10. The pressure relief mechanism provides for escape of the gas from the inside of the cylinder 10 to the surrounding area before the internal pressure reaches a level that is detrimental to the cylinder.

One of the conditions that can lead to a build up of pressure inside a storage cylinder 10 and the resulting need to relieve the pressure is exposure of the storage cylinder 10 to high temperatures.

In certain circumstances where the cylinder 10 is exposed to high temperatures, it is not desirable to release gas from inside the cylinder 10 into the surrounding environment. In these circumstances it is desirable to delay the opening of the pressure-relief mechanism for as long as possible. One such circumstance is where the elevated temperature is due to a fire and the storage cylinder 10 is filled with oxygen. Release of the oxygen into the surrounding environment in the case of a fire may feed or intensify the fire where the fire may have suffocated or smoldered out without the additional oxygen. The same would apply to cylinders containing toxic gases where release of the toxic gas may be avoided where the fire would have suffocated or smoldered.

The present invention provides a first container 16 for enclosing a storage cylinder 10. The cylinder 10 is filled with a compressed gas, such as oxygen.

The first container 16 is preferably constructed from a standard paperboard product such as a corrugated cardboard having a 350 pound test rating. The container 16 is preferably rectangular-shaped with a set of foldable flaps 18 at each end for sealing the container at opposite ends. The container 16 is preferably sealed with mechanical fasteners such as staples 17 or the like. Metal staples 17 are preferred because of their ability to withstand high temperatures and because once the container is opened, the staples are not easily reusable. Other options for fasteners include temperature-resistant glues or temperature resistant pressure sensitive adhesives such as tapes and the like.

Other types of fiberboard, paperboard, or cardboard would also be suitable for first container 16. Other strengths of corrugated cardboard would also be suitable depending on the size and weight of the storage cylinder 10 to be placed in the first container 16.

The cylinder 10 and its valve 13 at the inlet are typically packaged in a polyethylene bag 24 for protection. A cylindrical head ring 28 is preferably placed around the valve 13 such that one end of the head ring 28 contacts the body 25 of the cylinder 10 and the other end of the head ring 28 extends such that it is disposed adjacent to or in contact with and substantially square with respect to the end of the first container 16 when its foldable flaps 18 are closed. The head ring 28 is preferably constructed of 350 pound test corrugated cardboard, however, other cardboard, paperboard, or fiberboard as well as other relatively heat resistant materials would also be suitable. The bottom of the cylinder 10 is provided with a bottom ring 31. The bottom ring 31 is preferably a cylindrical section of cardboard having a first end that contacts the cylinder and an opposite second end that is square with the bottom of container 16 when the foldable flaps 18 are closed. The bottom ring 31 can also be constructed of alternate materials.

With the rings 28 and 31 disposed at opposite ends of the cylinder 10, the cylinder 10 is placed inside the first container 16 through an open end of the container 16. Any remaining space in the end of the container 16 is filled with dunnage 32. Next the foldable flaps 18 are closed to seal the container 16.

Figure 4:
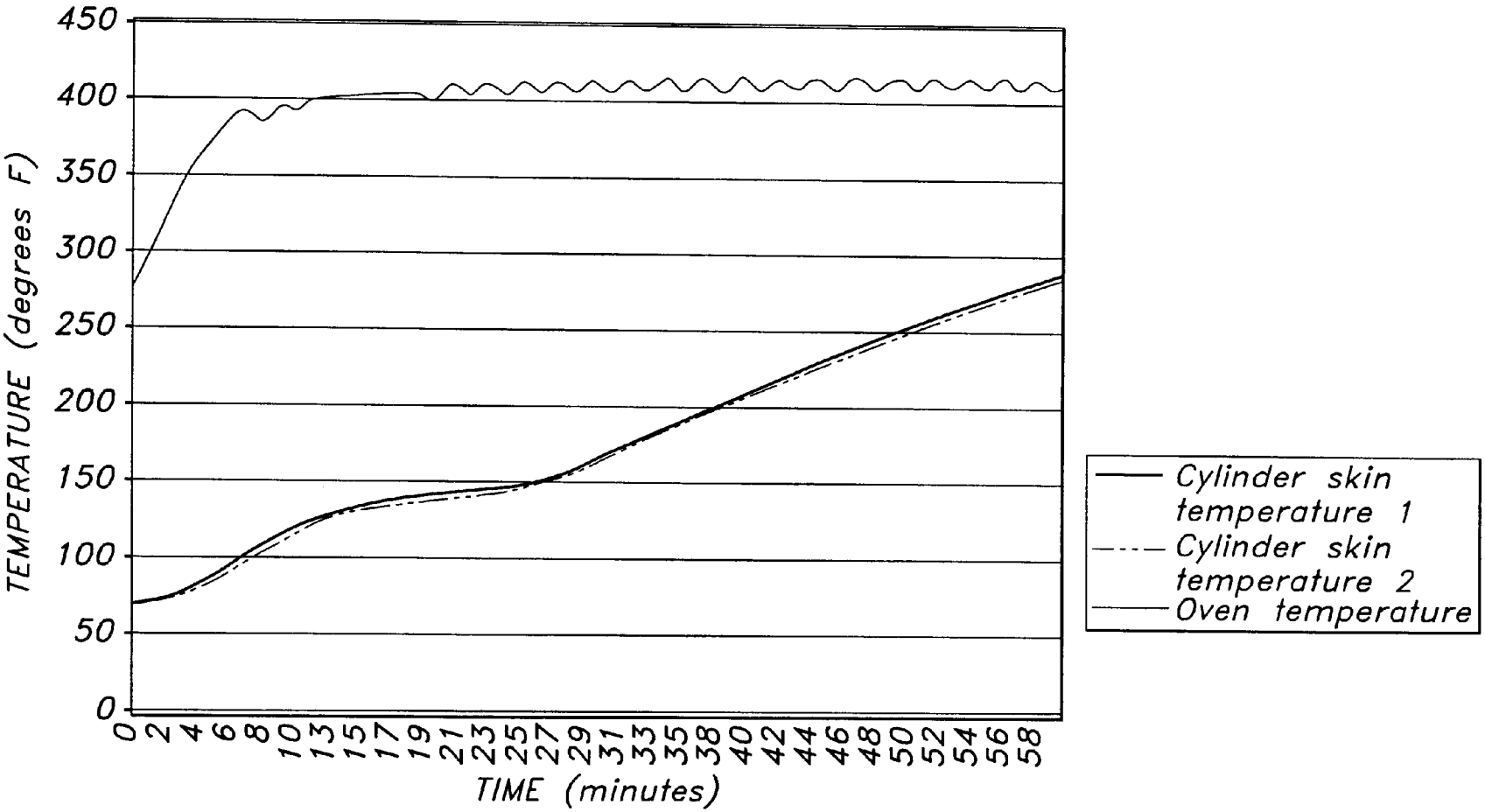
FIG. 4 is a graph illustrating the time-temperature curve for an 11 cubic foot cylinder placed in a standard cardboard container and exposed to a temperature of 400 degrees F.
Figure 5:
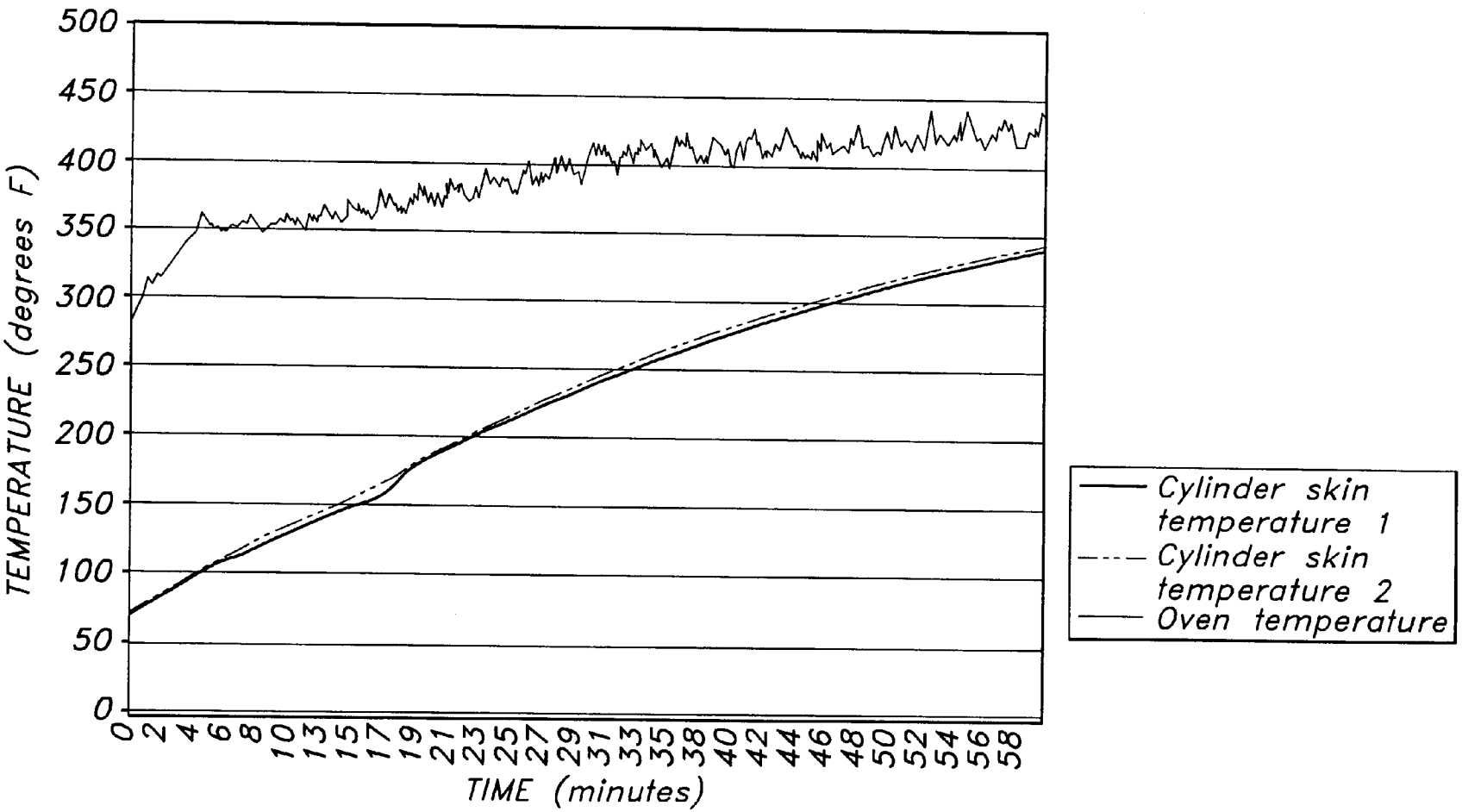
FIG. 5 is a graph illustrating the time-temperature curve for a 76 cubic foot cylinder placed in a standard cardboard container and exposed to a temperature of approximately 400 degrees F.
Figure 6:
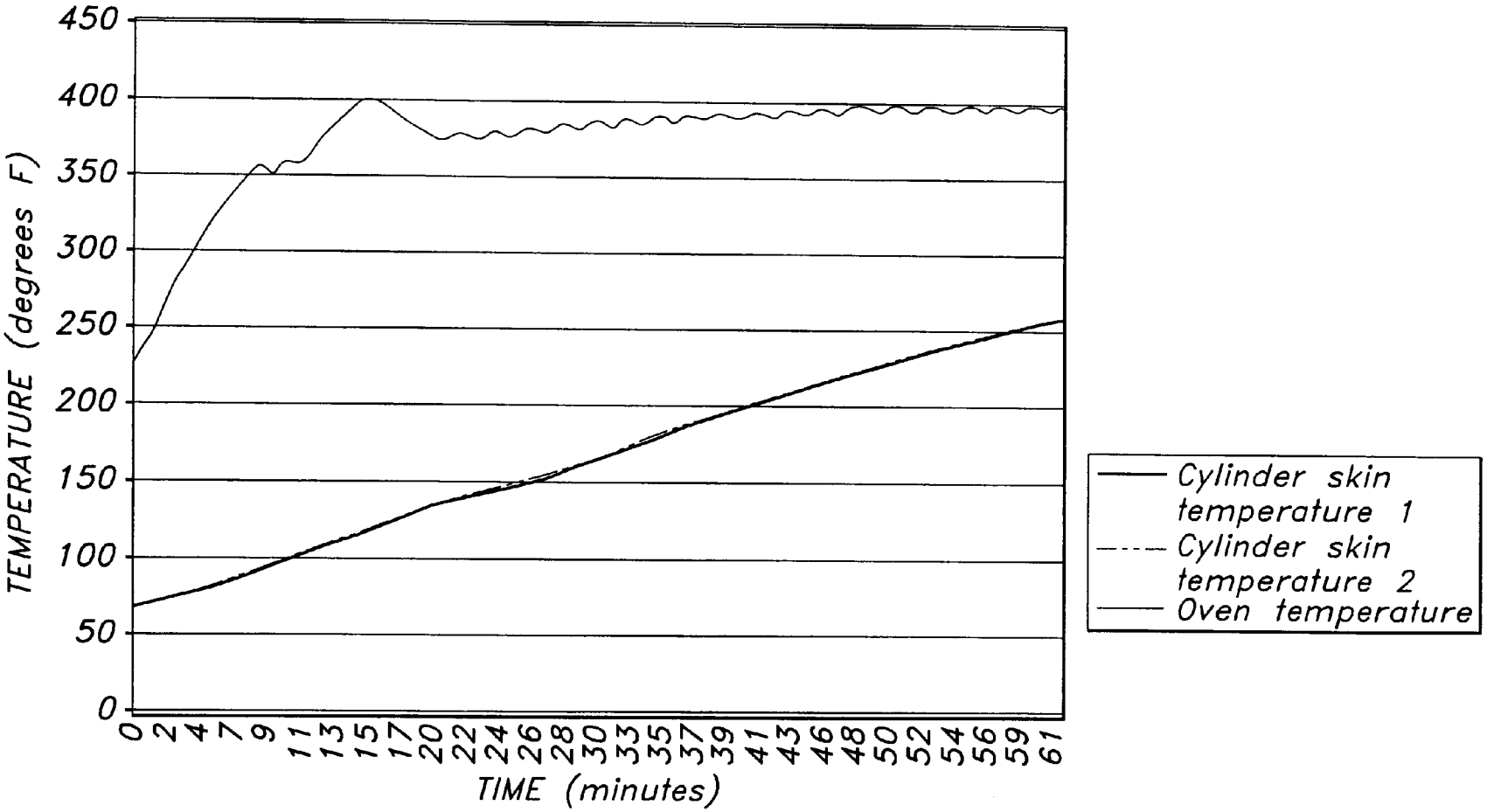
FIG. 6 is a graph illustrating the time-temperature curve for a 115 cubic foot cylinder placed in a standard cardboard container and exposed to a temperature of approximately 400 degrees F.

The first container 16 by itself provides limited protection for the cylinder 10 when exposed to elevated temperatures. As shown in FIGS. 4–6 for different size cylinders, the time-temperature curve indicates a relatively sharp slope for the skin temperature of the container 16 when subjected to a temperature of 400 degrees F. These temperature curves indicate inadequate protection for the cylinder 10 as the temperature approaches 300 degrees F in less than sixty minutes. 300 degrees F is the approximate temperature at which most cylinders equipped with a pressure relief mechanism will release their contents through the pressure relief mechanism.

In order to reduce the heat transfer from the surrounding environment to the cylinder 10, the first container 16 is provided with a thermal barrier 34. The thermal barrier 34 may comprise a fiber paper having sufficient flexibility such that it can be wrapped around the four sides of the first container 16. The barrier 34 may also be provided on the ends of the first container 16, but for ease of use the barrier 34 is preferably wrapped around the sides only. The barrier 34 may comprise LYTHERM® LDF large diameter fiber paper available from Lydall Technical Papers in Rochester, N.H. LDF paper has a maximum use temperature of 1500° F. and at ⅛ inch thickness has a tensile strength of 7300 g/in in the machine direction and 5500 g/in in the cross direction. The material has a density of 5–7 lbs./ft$^3$. Other thicknesses of LDF paper may also be suitable depending on the application.

As an alternative, the barrier 34 may comprise LYTHERM® ceramic fiber paper, Model No. 550-L and also commercially available from Lydall Technical Papers in Rochester, N.H. The ceramic fiber paper is processed from unwashed, spun, high purity alumina-silica fibers formed into a highly flexible sheet capable of easily being cut and formed to fit the exterior of the first container 16. The material is rated for a maximum use temperature of 2,300 degrees F. The typical chemical analysis is $Al_2O_3$ 47%, $SiO_2$ 52.62%. The density in lbs/ft$^3$ is 6 to 9. The dielectric strength is 50 volts/mil and the tensile strength is 5,800 g/in in the machine direction and 5,000 g/in in the cross direction. The material is rated 22 lbs/in$_2$in the Mullen burst test and has a nominal thickness of one-eighth of an inch thick.

The ceramic fiber paper provides low thermal conductivity and provides high heat reflectance which are both important properties for a thermal barrier material. Also, the material is resistant to thermal shock. Other materials having similarly low heat conductivity and or high heat reflective properties would also be suitable for the thermal barrier 34. It is to be understood that the thermal barrier 34 may comprise any suitable heat resistant material. The thermal barrier 34 may be fabricated from materials having different degrees of flexibility. The thermal barrier 34 preferably comprises a material having a high resistance to heat transmission, an ability to surround the first container 16, and a relatively low weight. Accordingly, the material may also be preformed into a less flexible shape capable of substantially covering the first container 16, or it may be applied to the first container 16 by other methods of applying thermal barriers as known to those of ordinary skill in the art.

As an alternative, the thermal barrier 34 may be disposed on the inside of the second container 50. The thermal barrier 34 may be disposed on the inside of the second container 50 by bonding or the like. Other means for disposing the thermal barrier 34 between the first and second containers 16, 50 may also be suitable.

Figure 3A:
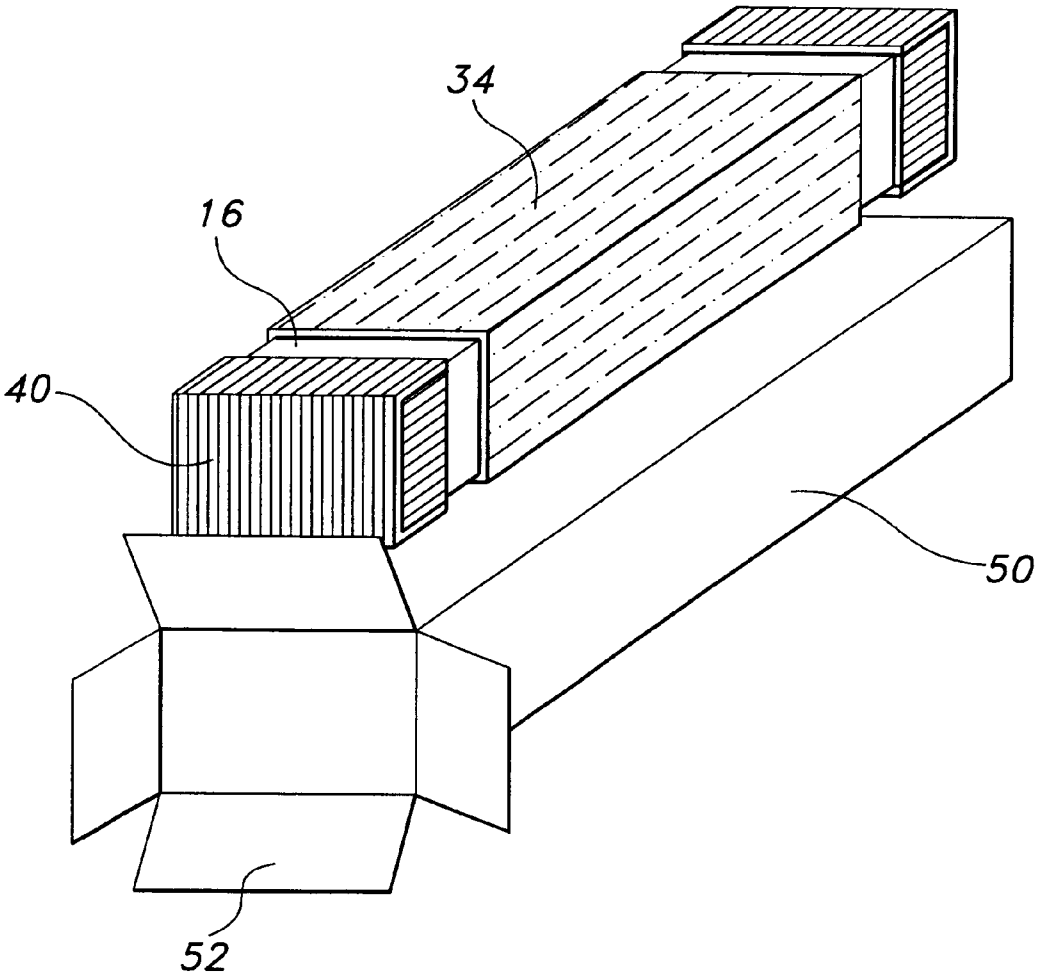
FIG. 3A is a perspective exploded view of the present invention.
Figure 3B:
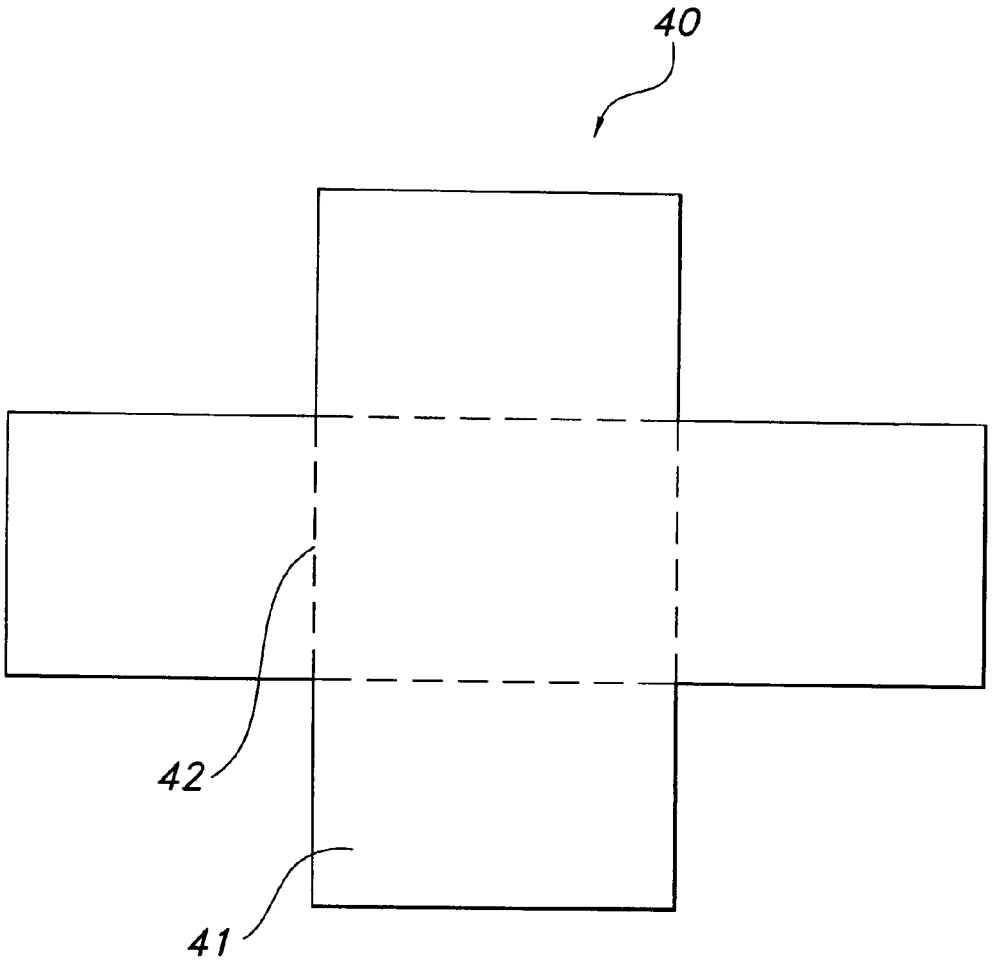
FIG. 3B is a plan view of an end cap spacer of the present invention.

With the sides of the first container 16 wrapped with the fiber paper, the ends of the first container 16 are provided with an end cap spacer 40. The spacer 40 is preferably constructed of corrugated cardboard and has four sections 41 hingedly connected to a mid-section as shown in FIG. 3B. The hinges 42 are formed where the material is flexible such that it is capable of being folded. The end cap spacer 40 extends across the end of the first container 16 and down each of the four sides of the first container 16 and overlays the fiber paper forming the thermal barrier 34. End cap spacers 40 are disposed at each end of the first container 16 to prevent contact between the first container 16 and the second container 50. Other shapes and materials for end cap spacer 40 may also be suitable depending on the size and shape of the cylinder 10 or other storage vessel.

Figure 2:
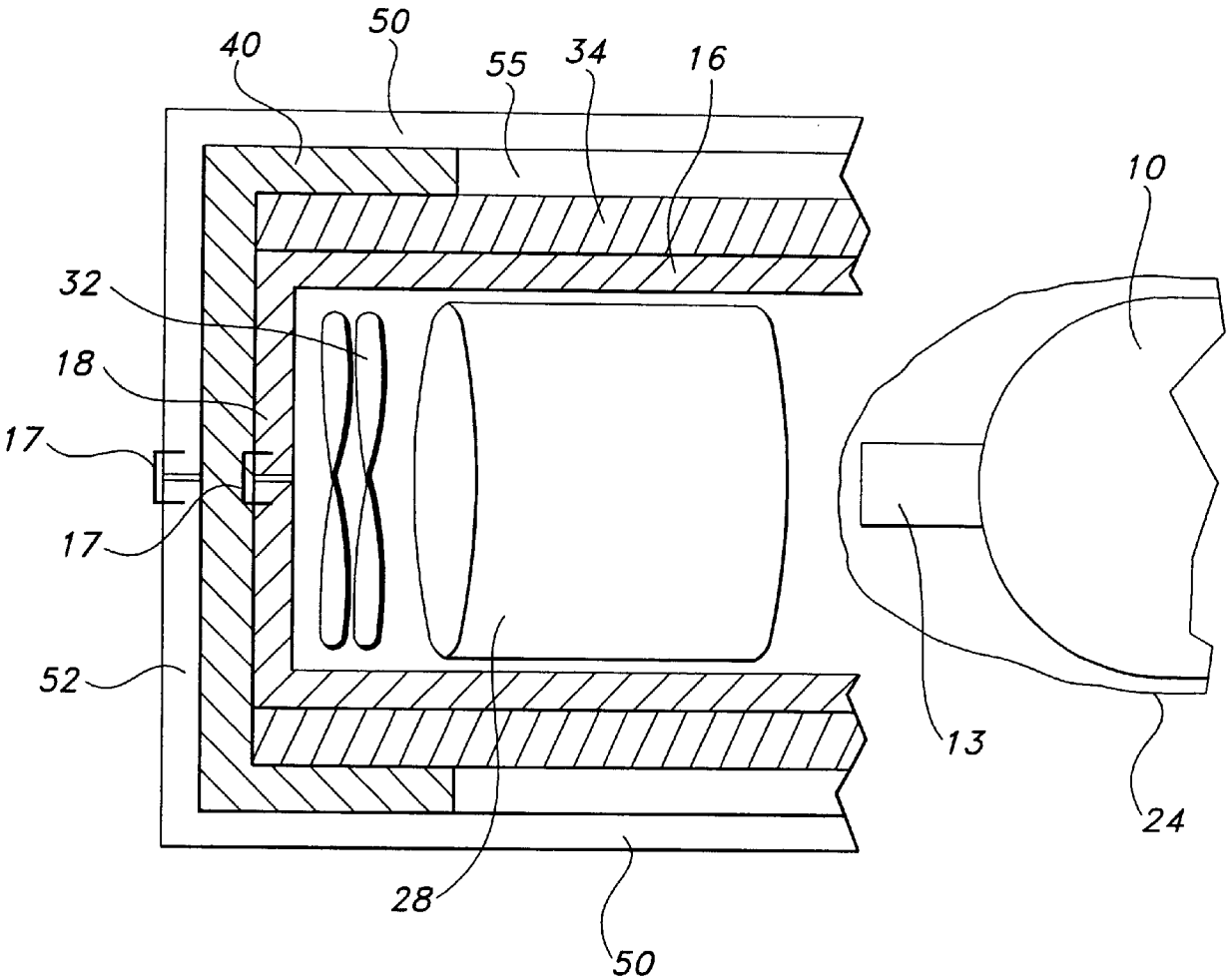
FIG. 2 is a partial cut-away plan view illustrating the apparatus and method of the present invention.

With the end cap spacers 40 disposed at opposite ends of the first container and overlaying the thermal barrier 34, the first container 16 is inserted into a second container 50. The second container 50 is shown in FIGS. 1 and 2 without section lines for clarity of illustration. The second container 50 is also preferably constructed of 350 pound test, corrugated cardboard. The container 50 is preferably rectangularly shaped and preferably has foldable flaps 52 at opposed ends such that openings at the respective ends of the container 50 can be sealed by folding the flaps inward over each other as known to those of skill in the art. With the first container 16 disposed inside the second container 50, the side walls of the first container 16 are preferably disposed apart from the side walls of the second container to form a gap 55. The gap 55 preferably has a width D, which is preferably one-quarter of an inch. Other dimensions for this insulating gap may also be suitable. The gap 55 may be left empty to form an air gap or it may be filled with insulating materials or the like. The end cap spacer 40 fills the gap at the opposite ends of the first container 16 and provides for a flush fit between the first container 16 and the second container 50 where the end cap spacer 40 covers the first container 16. The end cap spacer 40 occupies the space between the containers 16, 50 at the ends such that the first container 16 is obstructed from movement relative to the second container 50 once the second container 50 is sealed by folding the flaps 52 at the end of the second container 50.

Figure 3C:
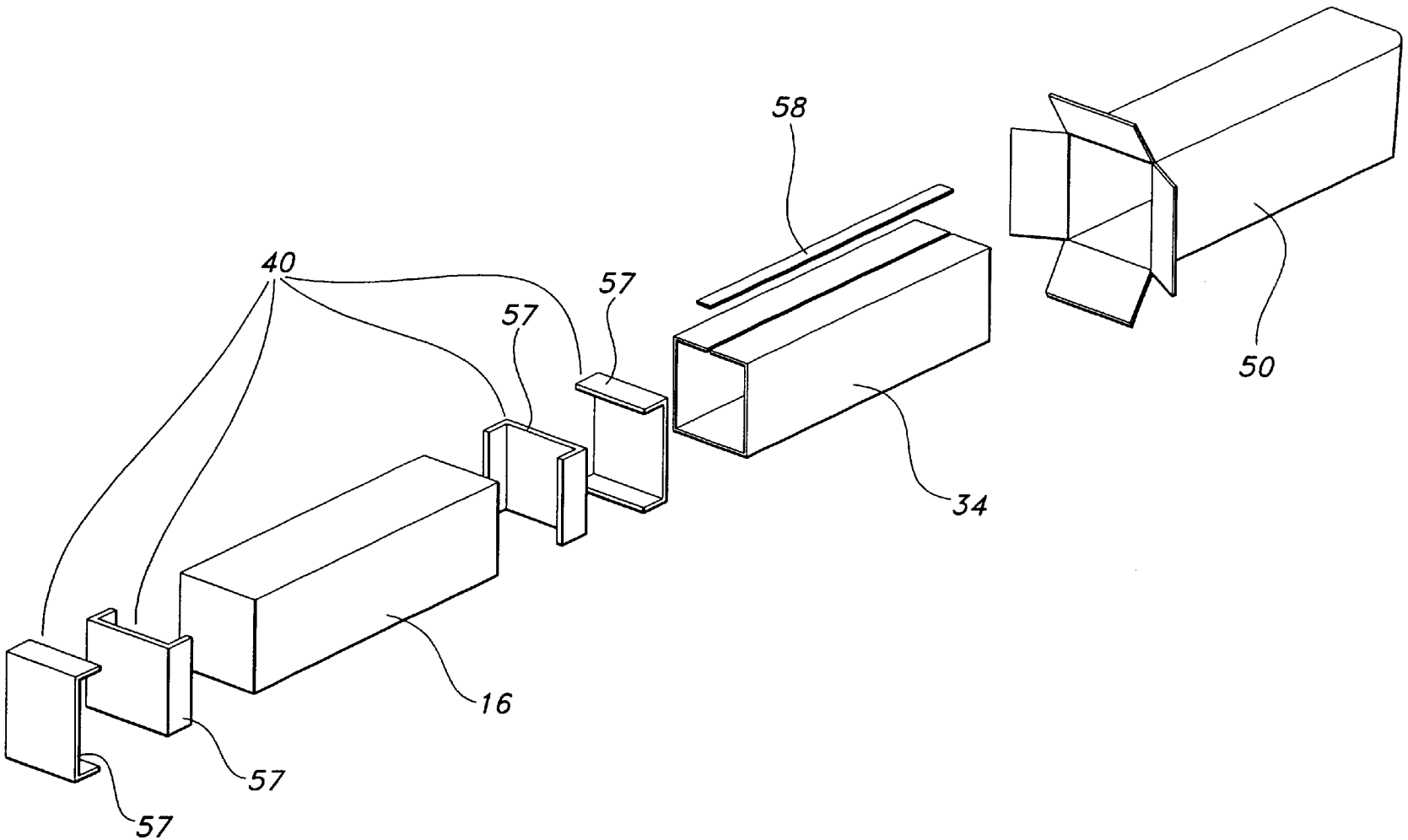
FIG. 3C is a perspective exploded view of the present invention with an alternate end cap spacer.

In FIG. 3C, an alternate configuration of the end cap spacer comprises a pair of U-shaped spacers 57 that overlay such that all four sides of the first container 16 are covered. Also, a high temperature tape 58 may be used to secure the ends of the thermal barrier 34. Other fasteners suitable for high temperature would also be suitable.

The second container 50 is provided with a flame retardant coating 60 comprising an intumescent system in a water resistant polymer latex. The coating may comprise PYROCIDE II™ commercially available from FRC Pyrotech in Carmel, Calif. When exposed to the high temperature of flames, the coating bubbles and foams into a thick, non-flammable, multi-cellular, carbonaceous char layer that insulates the protected material from heat while also restricting the flow of oxygen from the ambient air to the protected material. Other flame retardant coatings either mixed into the paper during the manufacturing of the corrugated cardboard or applied to cardboard by spraying, dipping, roller or brush and the like would also be suitable. The flame retardant coating may be applied to the exterior of the second container 50 or may be applied to both the exterior and interior of second container 50.

Figure 3D:
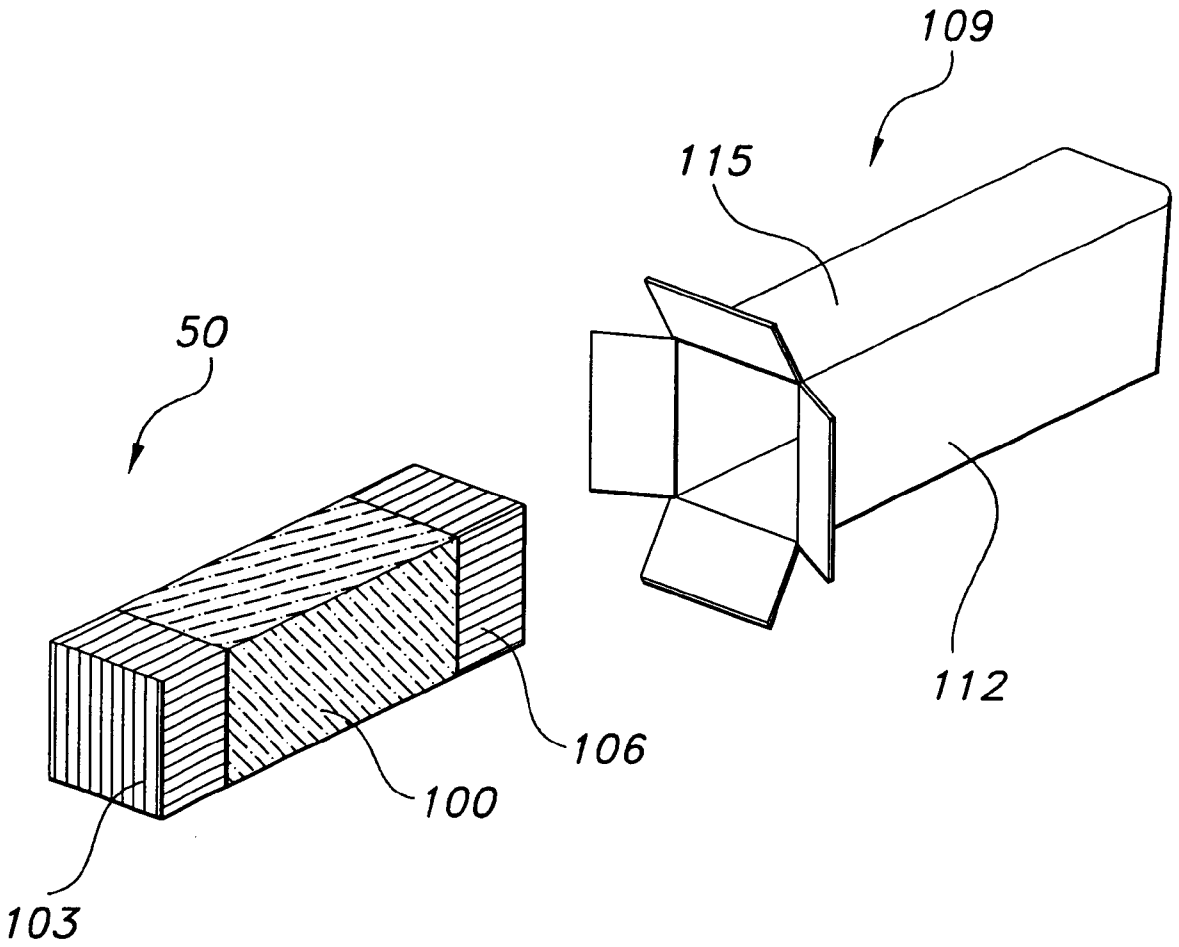
FIG. 3D is a perspective view of an alternate embodiment of the present invention including a third container.

In FIG. 3D, as an alternative, the second container 50 could be provided with a thermal barrier wrap 100 on the outside surface and a pair of end cap spacers 103, 106 for insertion into a third container 109. The end cap spacers 103, 106 would fit over the thermal barrier 100 and would hold the second container 50 in position inside the third container 109 such that the walls of the second container 50 are disposed in spaced apart parallel relation to the walls 112, 115 of the third container 109. The inner and outer walls of the third container 109 may also be provided with a flame retardant coating 60 as described above in connection with the second container 50. Also, as an alternative, the thermal barrier may be disposed on the inside surface of the third container.

As will be readily apparent to those of ordinary skill in the art, multiple containers with or without thermal barriers wrapped over them can be provided with end caps and placed into successively larger containers to provide multiple gaps. Also, the successive containers may include flame retardant coatings 60 on the inner and/or outer surfaces.

Figure 7:
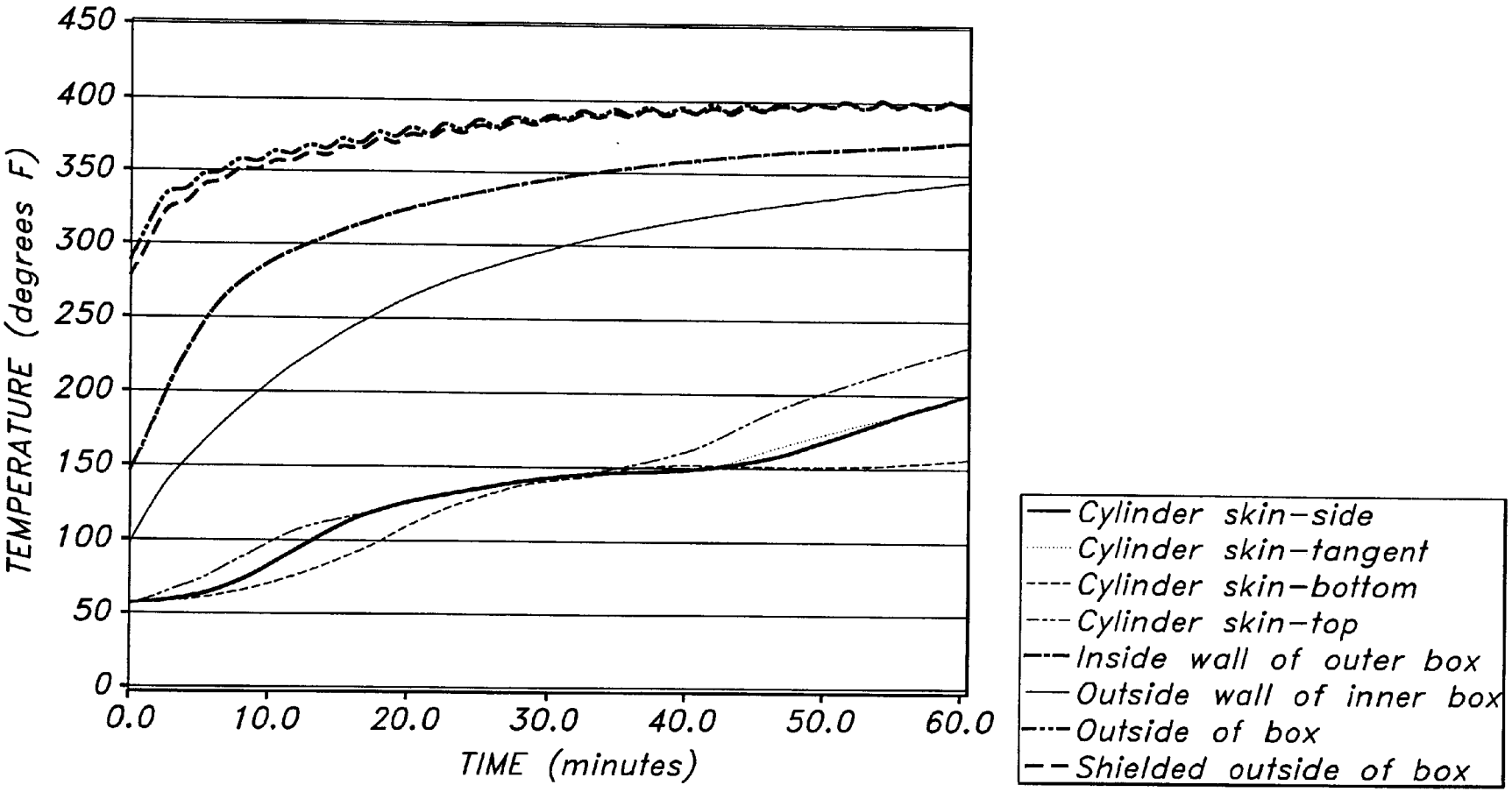
FIG. 7 is a graph illustrating the time-temperature curve for an 11 cubic foot cylinder placed in the container of the present invention and exposed to a surrounding temperature of approximately 400 degrees F.
Figure 8:
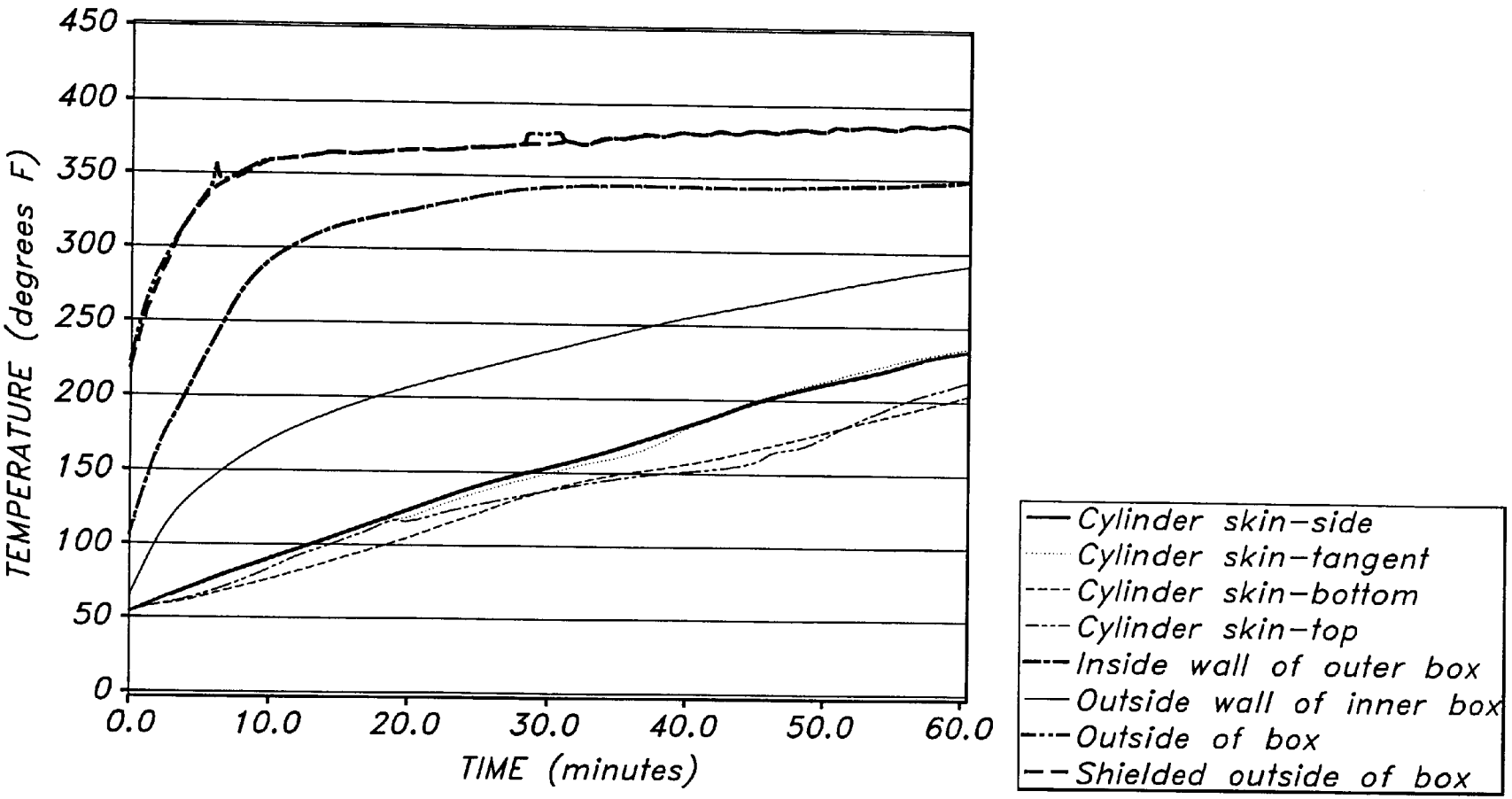
FIG. 8 is a graph illustrating the time-temperature curve for a 76 cubic foot cylinder placed in the container of the present invention and exposed to a surrounding temperature of approximately 400 degrees F; and, FIG. 9 is a graph illustrating the time-temperature curve for a 115 cubic foot cylinder placed in the container of the present invention and exposed to a surrounding temperature of approximately 400 degrees F.
Figure 9:
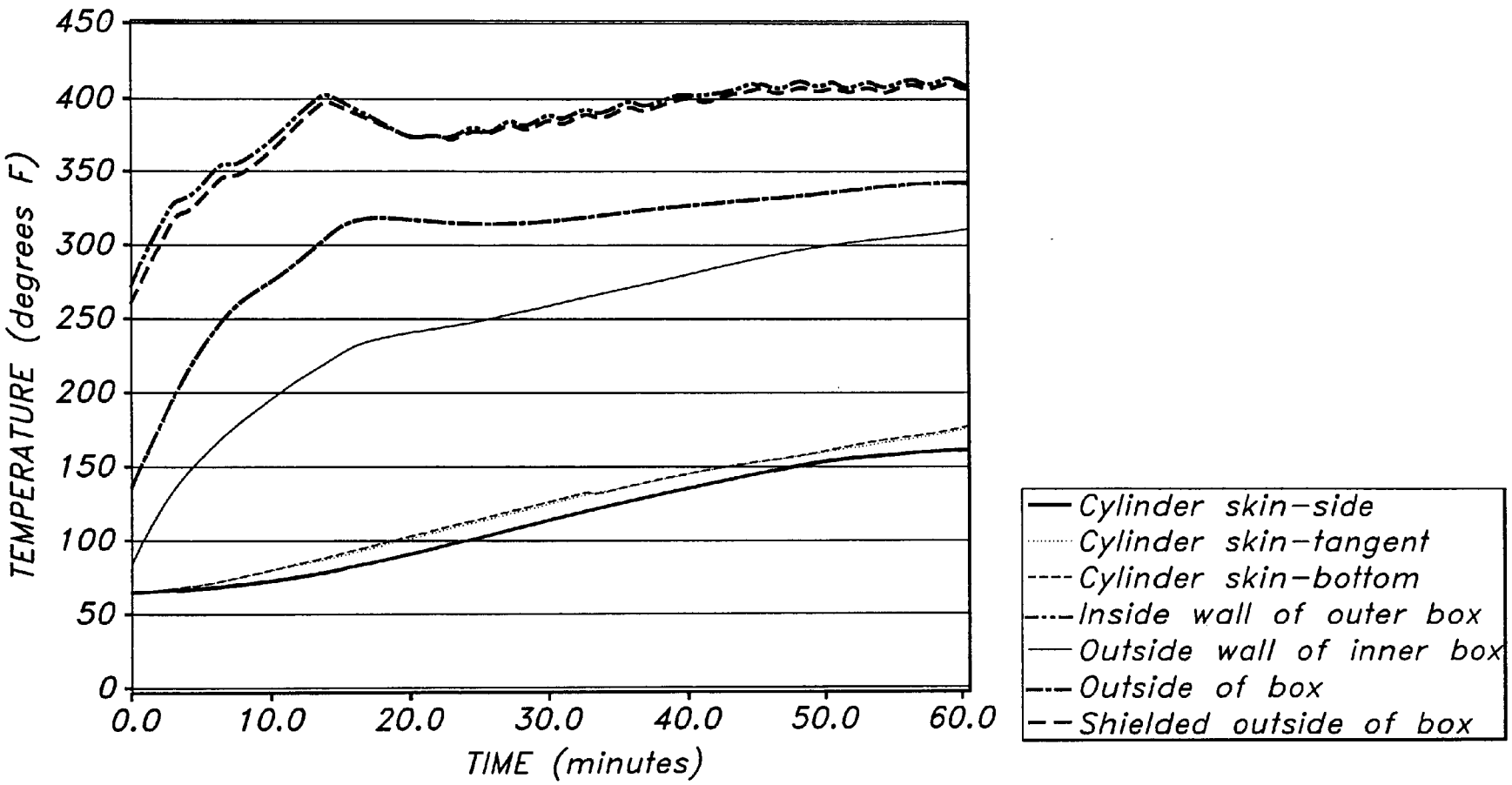

Referring to FIGS. 7–9, the apparatus and method of the present invention with first and second containers as described above provides a temperature curve having a much flatter slope. As shown, for cylinders 10 having 11 cubic foot (c.f.), 76 c.f., and 115 c.f. capacity, the temperature at the cylinder skin is maintained well below 300 degrees F for at least sixty minutes.

Accordingly, the present invention advantageously provides a single use overpack that extends the time before the pressure-relief mechanism is triggered when the cylinder is exposed to elevated temperatures and also provides thermal protection comparable to the ATA 300.

While the invention has been described in connection with certain preferred embodiments, it is not intended to limit the scope of the invention to the particular forms set forth, but, on the contrary, it is intended to cover such alternatives, modifications, and equivalents as may be included within the spirit and scope of the invention as defined by the appended claims.

What is claimed is:

1. In combination:

a first freestanding container having an outer surface, a first end, and a second end;

a compressed gas cylinder having a pressure relief valve, the cylinder disposed inside the first container;

a first end cap spacer at the first end of the first container;

a second end cap spacer at the second end of the first container;

a second freestanding container having an inner surface, the second container sized to receive the first container, the first end cap spacer and the second end cap spacer disposed between the first and second containers, the second container disposed such that the outer surface of the first container is disposed in spaced apart relation to the inner surface of the second container; and, a thermal barrier disposed between the first container and the second container.

2. The combination of claim 1, wherein the thermal barrier is a thermal barrier sheet wrapped around at least a portion of the outer surface of the first container.

3. The combination of claim 1, wherein the thermal barrier is a thermal barrier sheet disposed on the inner surface of the second container.

4. The combination of claim 1, wherein the second container has an outer surface with a flame retardant coating.

5. The combination of claim 1, further comprising a bottom ring disposed adjacent to the cylinder, the bottom ring having a curved shape engaging with the cylinder.

6. The combination of claim 5, further comprising a head ring disposed at the end of the cylinder opposite from the bottom ring, the head ring having a curved shape for engaging with the cylinder.

7. The combination of claim 1, wherein the first container has a plurality of side walls extending into flaps, the flaps capable of being folded to form end walls at opposite ends of the first container.

8. The combination of claim 7, wherein the thermal barrier substantially covers the plurality of side walls of the first container.

9. The combination of claim 1, wherein the first end cap spacer is disposed over the thermal barrier.

10. The combination of claim 1, wherein the second end cap spacer is disposed over the thermal barrier.

11. The combination of claim 1, wherein the second container has a flame retardant coating on the inner surface.

12. The combination of claim 1, wherein the first end cap spacer is unitary.

13. The combination of claim 1, wherein the first end cap spacer is formed by a pair of elements that overlie each other.

14. The combination of claim 1, wherein the thermal barrier has a maximum use temperature of at least 1500° F.

15. The combination of claim 1, wherein the thermal barrier comprises a ceramic fiber paper.

16. The combination of claim 15, wherein the ceramic fiber paper is formed from alumina-silica fibers.

17. The combination of claim 1, wherein the temperature at the cylinder skin is maintained below 300° F. for at least sixty minutes when the combination containing the cylinder is exposed to a temperature of approximately 400° F.

18. An overpack for packing a cylinder containing a compressed gas, the overpack comprising:

a first container having an outer surface, a first end, and a second end and being sized to be capable of receiving the cylinder, the first container having a plurality of side walls extending into flaps, the flaps capable of being folded to form end walls at opposite ends of the first container;

a first end cap spacer disposed at the first end of the first container;

a second end cap spacer at the second end of the first container; and, a second container having an inner surface, the second container sized to receive the first container with the first end cap spacer and the second end cap spacer disposed thereon such that the outer surface of the first container is disposed in spaced apart relation to the inner surface of the second container;

a thermal barrier disposed between the first container and the second container;

a third end cap spacer disposed at the first end of the second container;

a fourth end cap spacer at the second end of the second container; and, a third container having an inner surface, the third container sized to receive the second container with the third end cap spacer, and the fourth end cap spacer disposed thereon such that the outer surface of the second container is disposed in spaced apart relation to the inner surface of the third container.

19. The overpack of claim 18, wherein the thermal barrier substantially covers the plurality of side walls of the first container.

* * * * *